United States Patent [19]

Hetherington

[11] Patent Number: 4,846,302

[45] Date of Patent: Jul. 11, 1989

[54] ACOUSTIC MUFFLER

[75] Inventor: Theodore W. Hetherington, Jackson, Mich.

[73] Assignee: Tenneco Inc., Lincolnshire, Ill.

[21] Appl. No.: 894,634

[22] Filed: Aug. 8, 1986

[51] Int. Cl.[4] ..... F01N 1/10; F01N 7/18

[52] U.S. Cl. ..... 181/243; 181/252; 181/256; 181/258; 181/266; 181/272; 55/276; 55/DIG. 30

[58] Field of Search ..... 181/241, 243, 256, 265, 181/266, 258, 272, 247–255, 223, 231; 55/276, DIG. 30, DIG. 31

[56] References Cited

U.S. PATENT DOCUMENTS

| | | | |
|---|---|---|---|
| 2,072,961 | 3/1937 | Nelson | 181/256 |
| 3,109,511 | 11/1963 | Slayter et al. | 181/256 X |
| 3,112,007 | 11/1963 | Ludlow et al. | 181/256 X |
| 3,196,977 | 7/1965 | Senders | 181/256 |
| 3,209,857 | 10/1965 | Eckel | 181/256 |
| 3,233,697 | 2/1966 | Slayter et al. | 181/256 X |
| 4,234,054 | 11/1980 | Chapin | 181/272 X |
| 4,239,091 | 12/1980 | Negrao | 181/246 X |
| 4,467,887 | 8/1984 | Vizard | 181/265 |

FOREIGN PATENT DOCUMENTS 463925 4/1937 United Kingdom .

*Primary Examiner*—Benjamin R. Fuller
*Attorney, Agent, or Firm*—Harness, Dickey & Pierce

[57] ABSTRACT

A sound attenuating muffler for motor vehicle exhaust systems contains a fibrous glass cartridge with a binder-hardened outer shell surrounding a soft fibrous core through which a gas flow tube extends.

8 Claims, 2 Drawing Sheets

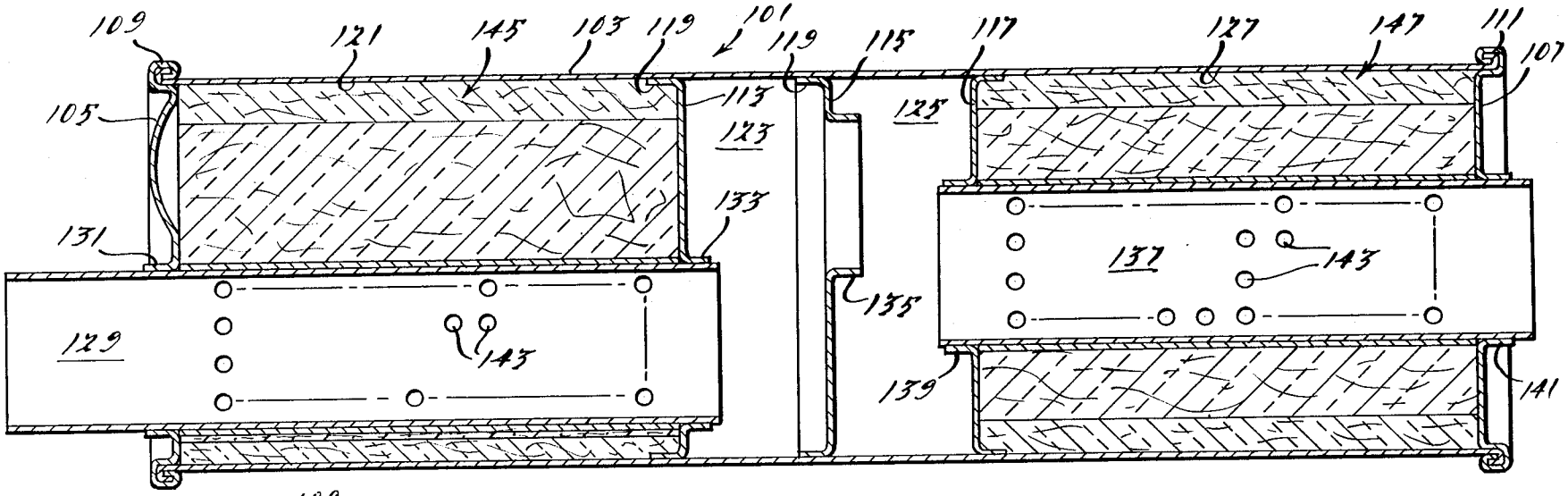
Fig. 6.
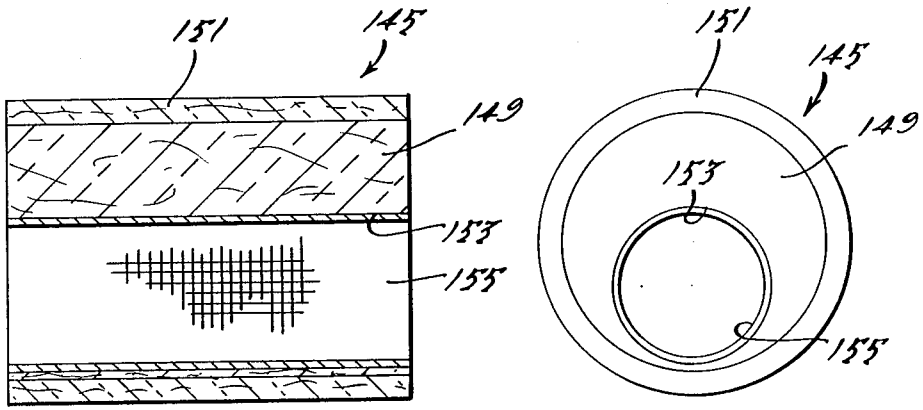
Fig. 9.
Fig. 8.
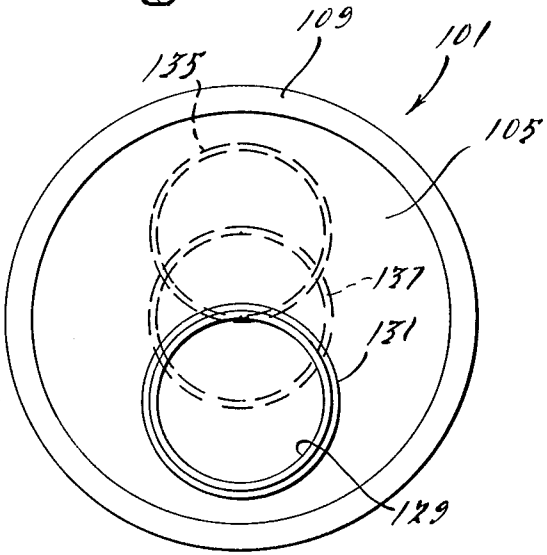
Fig. 7.

ACOUSTIC MUFFLER

BACKGROUND OF THE INVENTION

This invention relates to sound attenuating mufflers for motor vehicle exhaust systems and, in particular, to the use of cartridges formed of fibrous sound absorbent material in such mufflers. The use of cartridges of fibrous material in exhaust mufflers is shown in U.S. Pat. Nos. 2,072,961 (issued Mar. 9, 1937), 3,109,511 (issued Nov. 5, 1963), 3,112,007 (issued Nov. 26, 1963), and 3,233,697 (issued Feb. 8, 1966).

BRIEF SUMMARY OF THE INVENTION

It is the purpose of this invention to facilitate the efficient use of sound absorbent material in motor vehicle type exhaust mufflers. The invention accomplishes this purpose by means of a cartridge that is totally composed of fibrous sound absorbent material, preferable fibrous glass, and that has a relatively hard outer shell or case which is shaped to fit the outer wall of the muffler chamber in which it is used. The case may be formed by impregnating an outer layer of the cartridge with a liquid resin and then applying heat, while holding or molding the fibrous material in the desired shape, to cure and harden the resin whereby the resulting shell not only provides a preformed selected shape but confines and holds the fibrous sound absorbent mass and enables it to be efficiently handled in the muffler manufacturing process. The cartridge may be provided with one or more perforated tubes, as described herein, to receive gas flow tubes within the muffler.

Other features of the invention will become apparent hereinafter.

DESCRIPTION OF THE DRAWINGS

FIG. 6 is a longitudinal cross section through a round automotive exhaust gas muffler containing two performed fiberglass cartridges embodying the invention;

FIG. 7 is an end elevation of the muffler of FIG. 6 as taken from the left of FIG. 6;

FIG. 8 is a longitudinal cross section through a preformed cartridge similar to the one at the left in FIG. 6; and FIG. 9 is an end elevation of the cartridge of FIG. 8 as taken at the right of FIG. 8.

DESCRIPTION OF THE PREFERRED EMBODIMENTS

Figure 1:
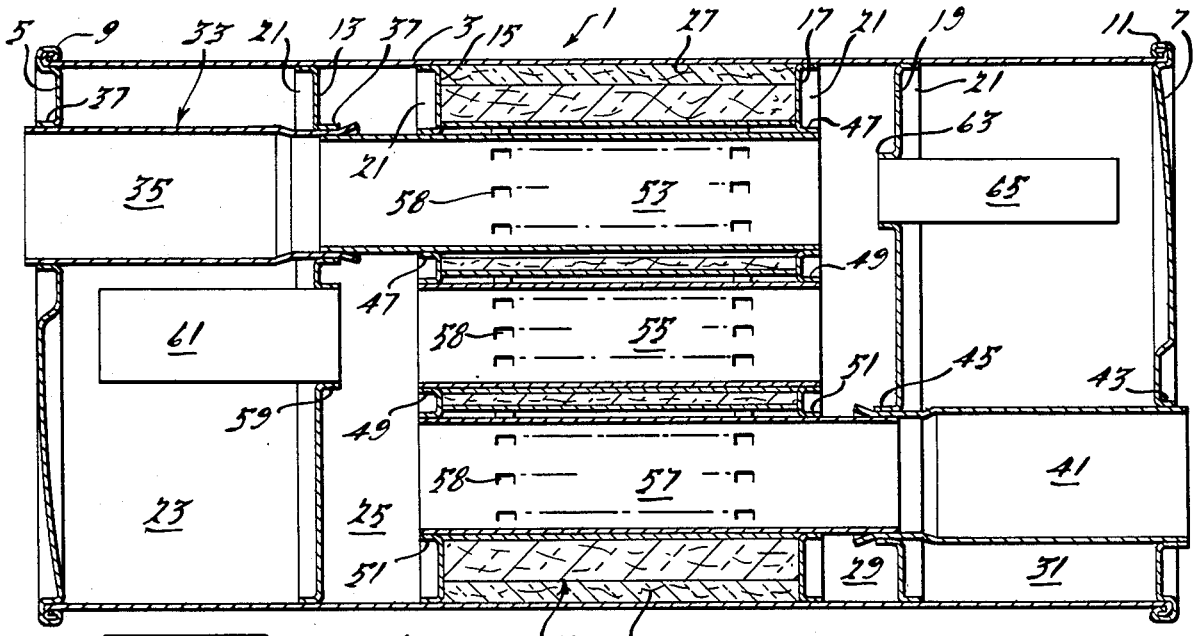
FIG. 1 is a longitudinal cross section through an oval tri-flow automotive exhaust gas muffler containing a performed fiberglass cartridge embodying the invention.
Figure 2:
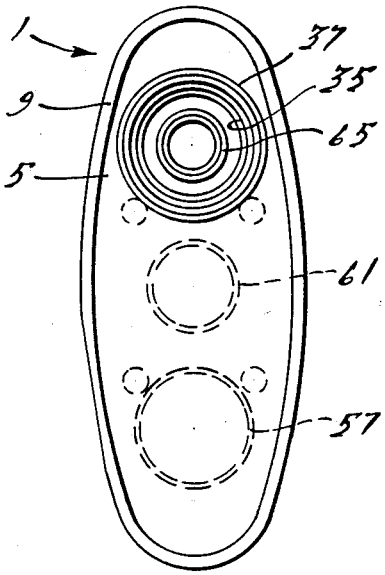
FIG. 2 is an end elevation taken from the left of FIG. 1.
Figure 3:
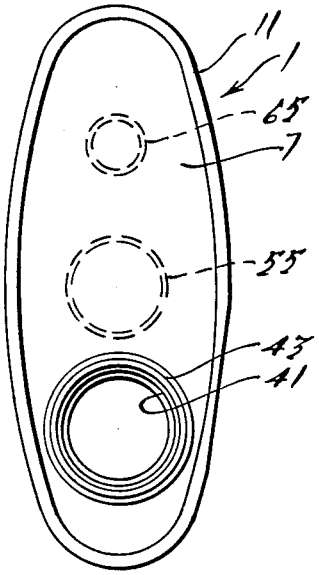
FIG. 3 is an end elevation taken from the right of FIG. 1.

The automotive type exhaust gas silencing muffler 1 of FIGS. 1 to 3 has a housing comprising a tubular sheet metal shell 3 of oval cross section that is closed at its left and right ends respectively, by sheet metal end headers 5 and 7 which are interlocked to ends of the shell 3 in gas tight oval-annular joints 9 and 11, respectively.

Within the shell 3 are four transverse partitions 13, 15, 17, and 19 which have peripheral flanges 21 fitting the inner surface of the shell and some or all of which may be affixed to the shell, as by spotwelding. The transverse partitions are longitudinally separated from each other, and in conjunction with the transverse end headers subdivide the interior of the muffler into five chambers, 23, 25, 27, 29, and 31.

Gas flow tube means 33 is mounted on the headers and partitions to provide a gas flow passage through the muffler from one end to the other. This means 33 includes a tube 35 extending from collared opening 37 in header 5 to collared opening 39 in partition 13. At the right end of the muffler the means 33 includes a tube 41 extending from collared opening 43 in header 7 to collared opening 45 in partition 19. The central partition 15 and 17 have three pairs of aligned collared openings 47, 49, and 51, pair 47 being aligned with tube 35 and pair 51 being aligned with tube 41. The tube means 33 includes three louver tubes 53, 55, and 57 (each having louvered openings 58) which are supported at opposite ends in the pairs of collared openings 47, 49, and 51, respectively. The tube 53 has a left end portion that extends away from partition 15 and fits inside of tube 35 and the tube 57 has a right end portion that extends away from partition 17 and fits inside of tube 41.

The muffler 1 has resonator chamber means at each end. At the left end this comprises a collared opening 59 in partition 13 aligned with tube 55 and which supports a tuning tube 61 that extends into chamber 23 and forms the only inlet and outlet to the chamber. At the right end the resonator chamber means comprises a collared opening 63 which is aligned with tube 53 and which supports a tuning tube 65 that extends into chamber 31 and forms the only inlet and outlet to the chamber. The dimensions of the tubes 61 and 65 relative to the volumes of their respective chambers 23 and 31 are chosen to enable predetermined, relatively low frequencies of sound to be attenuated.

Assuming that the left end of the muffler is the gas inlet end, the tube 35 is connected into the exhaust system (not shown) of a motor vehicle to receive gas that requires acoustic treatment to attenuate objectionable sound. This gas flows from tube 35 to louver tube 53 and from tube 53 into chamber 29. The direction of gas flow is reversed in chamber 29 and the gas enters the right end of louver tube 55 and flows back toward chamber 25 which reverses its direction of flow again so that it enters the left end of louver tube 57. By this time most of the acoustic energy and sound have been removed and the gas flows from tube 57 into tube 41 and out of the muffler into a tailpipe (not shown) forming a part of the exhaust system.

Instead of the left end being the inlet end, gas could enter the right end of the muffler. In this case the attenuation might be slightly different since, for example, gas would be flowing away from tuning tubes 61 and 65 instead of directly into them as it is with the flow just described.

The louvers 58 in conjunction with chamber 27, into which they open, act to attenuate medium to high frequencies, roughness, and spit noises from the gas. It is well known that non-metallic fibrous absorbent material, such as glass fibers, enhances sound attenuation and that by filling chamber 27 with such material more effective attenuation would be achieved in some applications then if the chamber were empty. Packing loose fibers into chamber 27 presents manufacturing problems and using batts or strips of fibers also presents problems because of the three parallel louver tubes 53, 55, 57. To avoid these problems, the invention provides a preformed cartridge 67 (composed preferably of fibrous glass) which is sized to fill chamber 27 and to slip over the three tubes before they are attached to both partitions 15 and 17. The cartridge 67 along with tubes 53, 55, and 57 and partitions 15 and 17 can be put together as a subassembly and then slipped or stuffed into the shell 3 at the time of final assembly of the muffler 1. While, generally speaking, it is not a new idea to use a fibrous cartridge for sound attenuation in a muffler (see, for example, U.S. Pat. Nos. 2,072,961 (issued Mar. 9, 1937), 2,705,541 (issued Apr. 5, 2955), 3,109,511 (issued Nov. 5, 1963), 3,112,007 (issued Nov. 26, 1963), and 3,233,697 (issued Feb. 8, 1966)), the cartridge of this invention is different from the known prior art and the difference facilitates acoustic use of fibrous glass especially in muffler chambers that contain one or more gas flow tubes.

Figure 4:
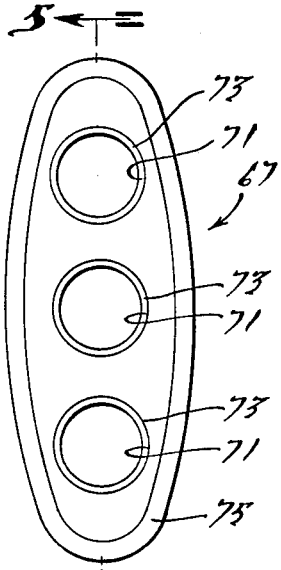
FIG. 4 is an end elevation of the novel cartridge of the invention prior to assembly into the muffler of FIGS. 1-3.
Figure 5:
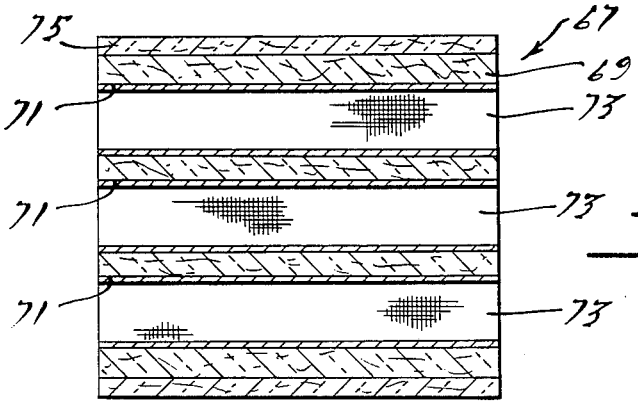
FIG. 5 is a longitudinal cross section through the cartridge of FIG. 4 as taken along line 5—5 of FIG. 4.

In accordance with a preferred form of the invention, unbound, unlubricated, fibrous glass 69 of about 7 micron average diameter is formed in a mold to the oval, annular, overall shape shown in FIGS. 4 and 5, i.e., a shape to slip-fit in chamber 27 and comprising an outer periphery to fit inside shell 3 and end faces to fit against partitions 15 and 17. Three longitudinal holes 71 for the tubes 53, 55, and 57 are cored into the cartridge to extend parallel to the axis of the cartridge and preferably the walls of these holes are lined with perforated sleeves 73. These must be able to withstand the relatively high temperatures within the muffler and would preferably be made of stainless steel screen, ceramic fiber mat or mesh, etc.

An essential feature of the invention is a relatively hard case or layer 75 forming the entire oval tubular outer part of the cartridge which is also composed of fibrous material. This may be formed by soaking or impregnating the outer surface of the fibrous glass body with a liquid uncured binder resin, such as phenol formaldehyde, and then heating the body whereby the outer, soaked layer is cured to form a relatively hard, shape-holding outer case 75 surrounding and containing a core of relatively soft fibrous glass in an unbonded condition. It can also be formed by means of a wrap-around impregnated glass fiber strip as mentioned hereinafter. It is preferred that the case or shell layer 75 be as thin as the strength-durability demands of handling in the muffler assembly process permit it to be. For example, satisfactory results have been obtained with an oval fibrous glass cartridge of about 3.9" minor diameter by about 10.3" major diameter when the case thickness was nominally 0.5". It is to be understood that due to the nature of the fibrous mass the penetration of the liquid binder is uneven so that the depth of the hardened case may also be uneven. The goal is not evenness but to obtain a hard, annular, fibrous shell 75 of minimum thickness around the outside of the fibrous glass core that will maintain its shape and enable the glass to be easily handled and assembled as a one-piece sound absorbent mass. The natural interlocking of the glass fibers and the interlocking with tubes 73 make it unnecessary to provide a case or hardened layers for the opposite end faces of the cartridge.

The preforated cartridge sleeves 73 are of a size to easily receive the louver tubes 53, 55, and 57 and their louvers 58. The sleeves retain their position within the fibrous mass by packing of the fibers around them and by interlocking of the glass fibers with the sleeves since the fibers will penetrate many of the sleeve perforations. Gas in the tubes can pulse into the fibrous glass core through the louvers and the perforations in the sleeve walls. This provides acoustic communication between the gas and the cartridge whereby the glass fibers thereby are able to perform their sound attenuating function.

The muffler 101 of FIGS. 6–9 illustrates the use of two fibrous mass cartridges according to the invention. This muffler has a housing comprising an annular sheet shell 103 of round cross section that is closed at its left and right ends, respectively, by sheet metal end headers 105 and 107 which are interlocked to the ends of shell in gas tight annular joints 109 and 111, respectively. Within the shell 103 are three transverse partitions 113, 115, and 117 which ave peripheral flanges 119 fitting the inner surface of the shell and some or all of which are spotwelded or otherwise affixed to the shell. The partitions along with the end headers subdivide the interior of the muffler into four chambers 121, 123, 125, and 127.

Means for providing a gas flow passage through the muffler 101 includes an inlet tube 129 that is supported in aligned collared openings 131 and 133 in head 105 and partition 113. This means also includes a collared opening 135 through partition 115, which is out of alignment with tube 129, and an outlet tube 137, which is offset from opening 135. The tube 137 is supported in aligned collared openings 139 and 141 in partition 117 and header 107, respectively. Tubes 129 and 137 have perforations 143 in their walls so that gas flowing through them is in communication with chamber 121 and 127, respectively. In accordance with the invention, the chamber 121 is filled with a fibrous glass cartridge 145 and the chamber 127 with a fibrous glass cartridge 147. These cartridges are similar to cartridge 67 but are round in cross section and have only one through hole since the chambers contain only one gas flow tube.

FIGS. 8 and 9 show cartridge 145 before assembly. Cartridge 147 is substantially the same as cartridge 145 but has a through hole for tube 137 that is coaxial with the centerline of the cartridge. Cartridge 145, like cartridge 67, comprises a mass 149 of fibers, preferably unbonded glass fibers with an average diameter of about 7 microns, that has a hard, shell-like, outer fibrous glass layer or case 151 that defines and fixes the sharp of the cartridge. A hole 153 extends through the mass 149 and it is lined with a perforated, ceramic mesh sleeve or the like 155, such as sleeves 73 mentioned above, As with cartridge 67, the case 151 may be formed by impregnating the outer surface of the fibrous body 149 with a liquid resin such as formaldehyde and then curing it through the application of heat. In lieu of impregnating the fibrous mass 149 itself, a relatively thin layer (e.g. about ½" for a 4" diameter round muffler) of resin impregnated fibrous glass could be used as a wrap around the unimpregnated fibrous core and heat applied to effect curing. After curing the result would be a cartridge formed totally of fibrous glass with a hard outer shell formed by the cured binder resin.

In operation with tube 129 serving as the gas inlet, gas to be silenced flow through the inlet tube 129 and some attenuation of medium and high frequencies and roughness occurs due to acoustic communication of the gas with the mass 149 of cartridge 145 by way of openings 143 in the tube 129. Gas leaving the tube 129 enters chamber 123 where it is forced to abruptly change direction (and lose energy) to pass through opening 135 into chamber 125. Again, an energy removing change of direction is required for gas to enter outlet tube 143. As gas flows through outlet tube 137 it is in communication with cartridge 147 through openings 143 whereby substantially attenuation of undesirable frequencies and sound has occurred by the time gas reaches the outer end of outlet tube 137.

Thus, the invention provides an acoustic component in the form of a fibrous mass shaped to be substantially symmetrical and/or predetermined in shape about a longitudinal axis and having its annual outer surface impregnated with a cured resin to define a hardened case that holds the mass to said symmetrical shape.

The illustrated fibrous glass components or cartridges 67, 145, and 147 with their relatively hard, shape-retaining, annular outer layers around soft fibrous cores therefore provide a means to improve the construction and production of motor vehicle exhaust system mufflers. Modifications in the specific details shown and described can be made without departing from the spirit and scope of the invention.

What is claimed is:

1. An acoustic muffler for attenuating sound in motor vehicle exhaust gases comprising a housing having inlet and outlet means for gas flow, means for providing a chamber having an annular outer wall defining a shape of the chamber, a cartridge composed of a soft core of unbonded fibrous glass sound absorbent material and including an annular fibrous hard outer shell of bonded fibrous glass sound absorbent material preformed to and retaining said chamber shape, gas flow means in said cartridge for allowing gas to flow through said soft core, said hard outer shell confining and holding said soft core so that said cartridge is adapted to be handled as a one piece component in assembly of the muffler, said cartridge having a slip fit inside said chamber with said outer shell engaging said annular wall, and gas passage means for the flow of exhaust gas between the inlet and outlet means and providing for acoustic communication of the exhaust gas with the gas flow means for the core of said cartridge.

2. A muffler as set forth in claim 1 wherein said gas flow means comprises at least one hole extending through said core and a preforated sleeve of high temperature withstanding material extending along a length of the hole.

3. A muffler as set forth in claim 2 wherein said gas passage means includes a gas tube extending through said perforated sleeve and having openings into the perforated sleeve to provide said acoustic communication.

4. A muffler as set forth in claim 1 wherein the fibers of said fibrous glass are about 7 microns in diameter and said fibrous glass core is unbonded and unlubricated.

5. An acoustic component for a motor vehicle exhaust muffler provided with inlet and outlet means for gas flow comprising a cartridge composed of a soft core of unbonded sound absorbent fibrous glass and a hard, molded annular outer shell of fibrous glass surrounding and containing said core to confine and hold said core and preformed to a predetermined shape whereby said fibrous glass cartridge may be handled efficiently in production and assembly of a muffler and inserted by slip fit into a muffler housing, and gas flow means through said core for allowing gas to flow from said inlet to said outlet means.

6. A component as set forth in claim 5 wherein said gas flow means comprises at least one hole extending longitudinally through said core and a preforated sleeve of high temperature withstanding material extending along a length of the hole.

7. An acoustic muffler for attenuating sound in motor vehicle exhaust gases comprising a tubular housing having inlet and outlet means for gas flow, said housing having a transverse chamber and at least one longitudinally extending gas flow tube passing through the chamber, a cartridge sized and shaped to fill said chamber and having an opening through said cartridge for passage of said gas flow tube, said cartridge being composed entirely of non-metallic fibrous sound absorbent material and having a soft core of said fibrous material in unbonded condition and a hard outer tubular shell of bonded fibrous material conforming in shape and and size to said tubular housing, whereby said cartridge is adapted to slip fit as a unit into said tubular housing and into said chamber with an outside of the outer tubular shell substantially in contact with an inside of said tubular housing, said hard outer tubular shell confining and holding said soft core fibrous material so that said cartridge may be handled efficiently in production and during assembly of said muffler.

8. A muffler as set forth in claim 7 including a perforated sleeve of high temperature withstanding material extending along a length of said opening in said cartridge, said gas flow tube extending through said sleeve.

* * * * *